US010995503B2

(12) United States Patent
Hayman et al.

(10) Patent No.: US 10,995,503 B2
(45) Date of Patent: May 4, 2021

(54) LOCKABLE SCAFFOLD TOEBOARD SYSTEM USING SLEEVES

(71) Applicants: Yates Westley Hayman, Walker, LA (US); Johnny Curtis, Denham Springs, LA (US)

(72) Inventors: Yates Westley Hayman, Walker, LA (US); Johnny Curtis, Denham Springs, LA (US)

( * ) Notice: Subject to any disclaimer, the term of this patent is extended or adjusted under 35 U.S.C. 154(b) by 179 days.

(21) Appl. No.: 15/335,077

(22) Filed: Oct. 26, 2016

(65) Prior Publication Data

US 2018/0112420 A1 Apr. 26, 2018

(51) Int. Cl.
*E04G 5/00* (2006.01)
*E04G 5/14* (2006.01)
*E04G 7/26* (2006.01)

(52) U.S. Cl.
CPC ..... *E04G 5/145* (2013.01); *E04G 7/26* (2013.01)

(58) Field of Classification Search
CPC ..... E04G 7/28; E04G 2007/285; E04G 7/34; E04G 7/00; E04G 5/145; E04G 5/142; E04G 5/06; E04G 7/22; E04G 1/152; E04G 7/308
See application file for complete search history.

(56) References Cited

U.S. PATENT DOCUMENTS 2,136,696 A 11/1938 Lamb
3,733,054 A * 5/1973 Storch ..... E04F 11/1812 256/59
3,752,262 A 8/1973 Helms
3,992,118 A 11/1976 Siegers
(Continued)

FOREIGN PATENT DOCUMENTS

CA 2983294 A1 * 10/2016 ..... E04G 1/152
DE 102012216681 A1 3/2014
(Continued)

OTHER PUBLICATIONS

PCT Application No. US2017/058097; International Search Report and Written Opinion of the International Searching Authority for Applicant Deltak Manfacturing, Inc. dated Dec. 8, 2017.

*Primary Examiner* — Daniel P Cahn
(74) *Attorney, Agent, or Firm* — Intellectual Property Consulting, LLC; Bernard F. Meroney

(57) ABSTRACT

A scaffold toeboard system for locking a toeboard between two vertical scaffold members where each vertical scaffold member includes a tubular member having a diameter and an outer shape. The toeboard system includes a toeboard having an elongated member with a fixed terminating end and an adjustable terminating end. The toeboard further includes a front portion, a top edge, a bottom edge, and a rear portion. The toeboard system further includes a second sleeve fixed to the fixed end of the toeboard, and a first sleeve fixed to the adjustable end of the toeboard. Slidably positioned in the first sleeve is a slide lock sleeve. The toeboard system includes a locking mechanism positioned at the adjustable terminating end, to fix the position of the slide lock sleeve to the first sleeve. The slide lock sleeve includes two fingers or tabs extending outwardly from the front edge of the slide lock sleeve. The two fingers are separated by a horizontal distance of about the diameter of a scaffold vertical member.

14 Claims, 21 Drawing Sheets

(56) References Cited

U.S. PATENT DOCUMENTS

| | | | | |
|---|---|---|---|---|
| 4,140,414 | A | 2/1979 | Buttgereit | |
| 4,273,463 | A | 6/1981 | Dobersch | |
| 4,445,307 | A | 5/1984 | Puccinelli et al. | |
| 5,028,164 | A | 7/1991 | Williams | |
| 5,704,449 | A * | 1/1998 | Ono | E04G 1/15 182/113 |
| 5,842,685 | A * | 12/1998 | Purvis | E04G 21/3223 256/67 |
| 5,961,240 | A | 10/1999 | Bobrovniczky | |
| 6,405,830 | B1 * | 6/2002 | Hayman | E04G 5/14 182/113 |
| 6,415,891 | B1 * | 7/2002 | Hayman | E04F 11/00 182/178.1 |
| 7,077,239 | B1 * | 7/2006 | Hayman | E04G 1/15 182/178.1 |
| 2005/0189173 | A1 | 9/2005 | Becker | |
| 2010/0224447 | A1 * | 9/2010 | Rogers | E04G 5/08 182/222 |
| 2013/0015015 | A1 * | 1/2013 | Pedicone, Jr. | E04G 7/28 182/113 |
| 2014/0299413 | A1 * | 10/2014 | Hayman | E04G 7/32 182/186.8 |
| 2015/0034420 | A1 * | 2/2015 | Watson | E04G 1/152 182/222 |

FOREIGN PATENT DOCUMENTS

| | | |
|---|---|---|
| GB | 2346650 B | 8/2002 |
| GB | 2386638 A | 9/2003 |

* cited by examiner 7000
6000
5000
5200
1

BACK SIDE VIEW

PLAN VIEW

ELEVATION VIEW

SECTION "A"–"A"

SECTION "B"–"B"

SECTION "C"–"C"

FIG. 9C
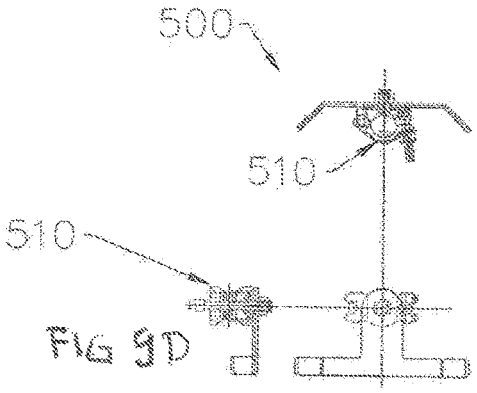
FIG. 9B
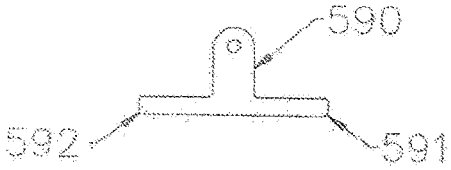
FIG. 9A

FIG. 10C
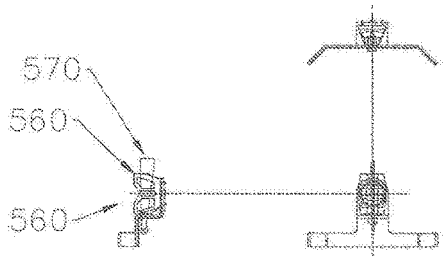
FIG. 10D
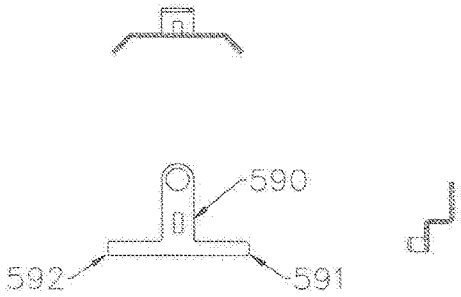
FIG. 10B
FIG. 10A

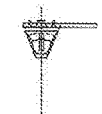
FIG. 11C
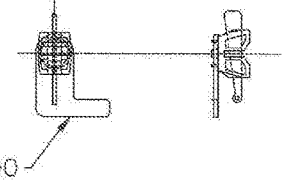
FIG. 11B
FIG. 11D
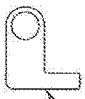
FIG. 11A
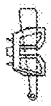

SAFE WAY

SECTION "A"–"A"

NEXT GENERATION

SECTION "A"–"A"

WEDGE LOCK

SECTION "A"–"A"

FIG. 15C
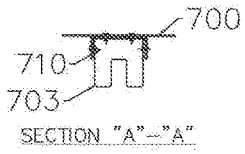
FIG. 15B
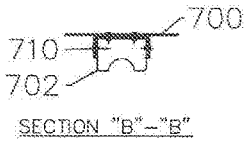
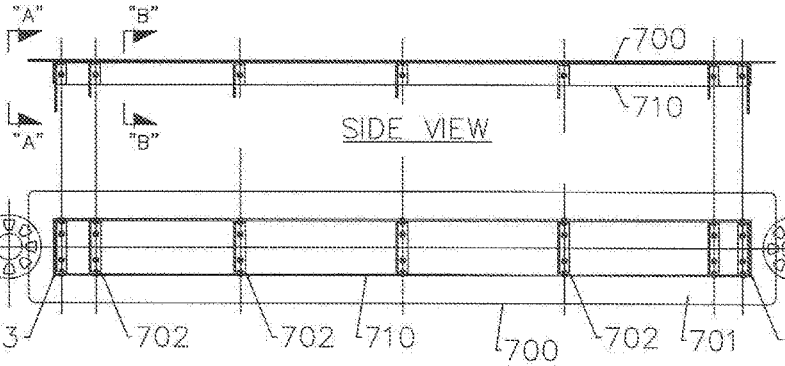
FIG. 15D
FIG. 15A

LOCKABLE SCAFFOLD TOEBOARD SYSTEM USING SLEEVES

TECHNICAL FIELD

This invention relates to scaffolding, and in particular, to scaffold toeboard systems.

BACKGROUND ART

Scaffold structures generally have a framework of horizontal scaffold members (horizontal members or horizontals) and vertical scaffold members (vertical members or verticals) which create a structure for supporting an elevated platform work area. The platform decking generally consists of scaffold boards, constructed of either metal or wood. OSHA requires all scaffold decks to include "toeboards." Toeboards are boards that attach to the scaffold structure near the outer perimeter or edges of the work platform and function to keep materials from falling or rolling off the work platform. Toeboards can also be used to secure the platform deck to the scaffold frame.

One general practice is to use 2×4 or 2×6 lumber as toeboards. These wooden toeboards may be nailed to the platform or wired to the platform with tiewraps or bailing wire. As the work platform can vary in size, each platform requires toeboards to be cut to size on the job site, or that various standard sizes are kept in stock. Much scaffolding is exposed to weather. Due to weathering, wooden toeboards may be used several times, and then have to be discarded. Metal toeboards are available, such as metal boards that couple to a stub member or sleeve that attaches to a vertical scaffold member, such as described in U.S. Pat. No. 6,405,830, hereby incorporated by reference.

Modular system scaffold systems (system scaffolds) are scaffold horizontal and vertical members that use interlocking or latching horizontal scaffold members and vertical scaffold members. Generally, the vertical scaffold members have a series of vertically spaced apart outwardly extending annular members, such as upstanding cups or rosettes, onto which a connector, located on the end of a horizontal scaffold member, will latch or lock onto. System scaffolds are designed for ease of assembly and disassembly, latching the horizontal scaffold connector on a scaffold horizontal into the annular member on a scaffold vertical. Various system scaffolds are available with different latching systems, such as pivoting latched end connectors (Excel Modular Scaffold (see U.S. Pat. No. 5,028,164), or Next Generation Scaffold Systems or Next Gen, U.S. patent publication 2014/0299413), wedging latch members (Safeway Scaffold Systems) (horizontal wedge, see U.S. Pat. No. 4,445,307) or pin lock or wedge lock systems (vertical wedge, see U.S. Pat. Nos. 4,273,463 and 5,961,240), intermating twisting cups (Cuploc Systems, see U.S. Pat. No. 3,992,118), and others. The vertical members in system scaffolds are generally tubular shaped (for instance, round or square in cross section) and will have a series of spaced apart annular members fixed on and extending outwardly from the tubular member. Each tubular member will have a diameter (for a cylinder, the diameter is the diameter of the cylinder; for a square cross-sectional tubular member, the diameter would be the width of the cross-section). The annular members, such as rosettes with openings therethrough, or upstanding cups, are spaced apart on the vertical tubular member to allow flexibility in the height of attachment of the horizontal members (which attach or rest on the annular members). The vertical spacing varies from manufacturer to manufacturer and system to system. Consequently, a toeboard system that can be used on most system scaffolds is desired, as well as a toeboard system that could be used on tube and clamp scaffolds, where the horizontal scaffold members terminate in tube clamps at each end, and simply clamp onto a vertical scaffold member.

OBJECTS OF THE INVENTION

It is an object of the invention to provide a scaffold toeboard system which is easily mounted on a scaffold frame and locked in place.

It is an object of the invention to provide a scaffold toeboard system where the toeboard directly couples to scaffold vertical members using sleeves.

SUMMARY OF THE INVENTION

One embodiment of the invention includes a scaffold toeboard system for locking between two vertical scaffold members where each vertical scaffold member comprises a tubular member having a diameter and an outer shape. The toeboard system comprises a toeboard formed from an elongated member having a fixed terminating end and an adjustable terminating end, the toeboard further comprising a front portion, a top edge, a bottom edge and a rear portion. The toeboard system further includes a first sleeve fixed in place at the adjustable terminating end, and a slidable locking sleeve slidably mounted in the first sleeve. A second sleeve is fixedly mounted in the fixed terminating end of the toeboard. The slide lock sleeve includes a body having a top edge, a bottom edge, and a front edge, and two tabs positioned on the body and extending outwardly from the front edge of the body, where the two fingers are separated by a horizontal distance of about the diameter of a scaffold vertical member. The adjustable end further preferably includes a lock member, where the lock member is actuated to fix (or release) the position of the slide lock sleeve with respect to the first sleeve. The second sleeve preferably has one or more projecting fingers or tabs positioned on the front edge of the second sleeve.

BRIEF DESCRIPTION OF THE DRAWINGS

FIG. 9A is a front view of one embodiment of a toeboard holddown body.

FIG. 9B is a front view of one embodiment of a toeboard holddown.

FIG. 9C is a top view of the embodiment of the toeboard holddown of FIG. 9B.

FIG. 9D is a side view of the embodiment of the toeboard holddown of FIG. 9B.

FIG. 10A is a front view of one embodiment of a toeboard holddown body.

FIG. 10B is a front view of another embodiment of a toeboard holddown.

FIG. 10C is a top view of the embodiment of the toeboard holddown of FIG. 10B.

FIG. 10D is a side view of the embodiment of the toeboard holddown of FIG. 10B.

FIG. 11A is a front view of another embodiment of a toeboard holddown body.

FIG. 11B is a front view of another embodiment of a toeboard holddown.

FIG. 11C is a top view of the embodiment of the toeboard holddown of FIG. 11B.

FIG. 11D is a side view of the embodiment of the toeboard holddown of FIG. 11B.

FIG. 15A is a top view of one embodiment of a filler board.

FIG. 15B is a cross sectional view of the filler plate of FIG. 15A.

FIG. 15C is another cross sectional view of the filler plate of FIG. 15A.

FIG. 15D is a side view of the embodiment of the filler plate of FIG. 15A.

DETAILED DESCRIPTION

Figure 1A:
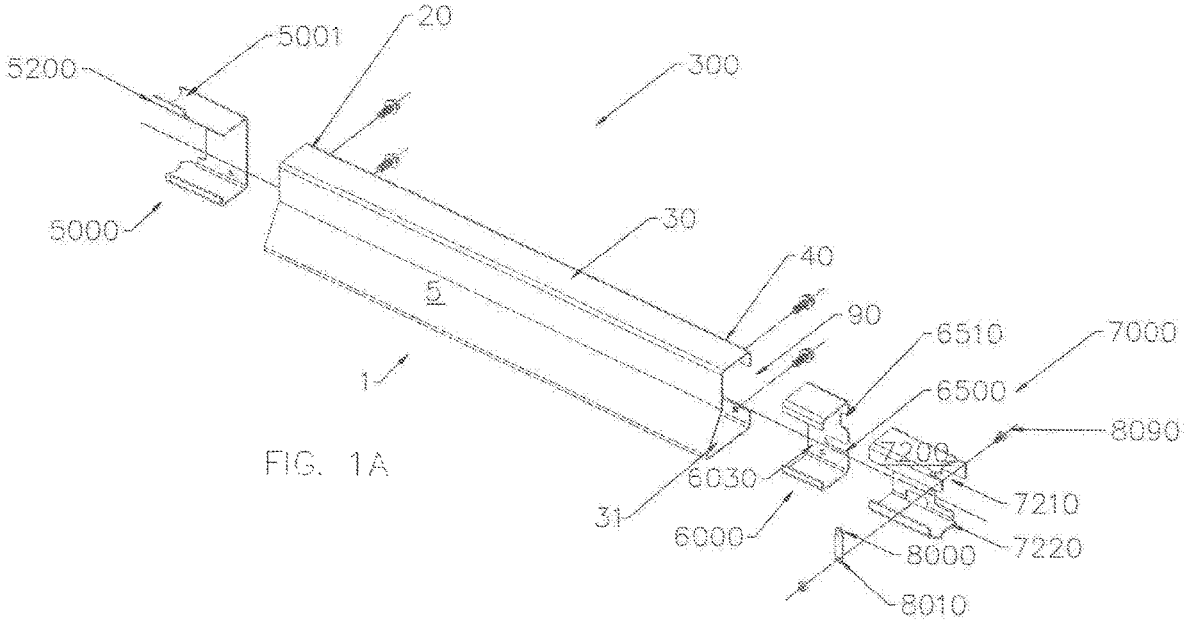
FIG. 1A is a perspective front exploded view of one embodiment of the toeboard system.
Figure 1B:
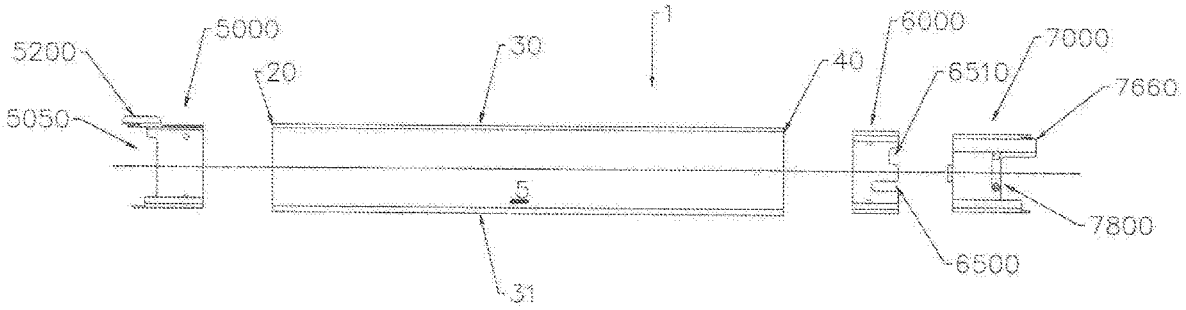
FIG. 1B is a front exploded elevation view of the toeboard system of FIG. 1A.

Shown in FIGS. 1A, 1B, 1C and 1D and 16, is one embodiment of a toeboard system 300. The toeboard system 300 has a primary member, an elongated board-like member, toeboard 1, manufactured in various lengths. The toe board 1 is generally manufactured from flat material that is folded into the desired shape. As shown in FIG. 1A, preferably toeboard 1 terminating ends 20 and 40 have little or no cutting or machining, other than the folding of the flat metal to from the shape of the toeboard. The shaped ends of the toeboard system needed to interface a vertical scaffold members will be separately formed in sleeves, a first sleeve 6000, and a second sleeve 5000, attached to the toeboard 1. In this fashion, manufacturing costs can be reduces, as machining of the elongated toeboard is minimized.

Figure 4B:
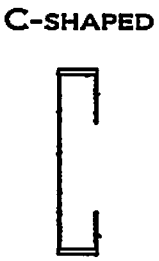
FIG. 4B is a cross sectional view though one embodiment of a first, second or slide lock sleeves.
Figure 4A:
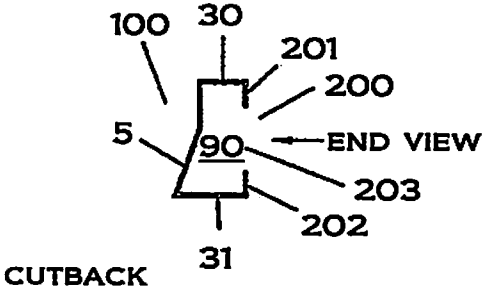
FIG. 4A is a cross sectional view though one embodiment of a toeboard.

The toeboard body 1 defines a lengthwise axis, generally along a line extending between the two terminating ends (e.g., a line extending between the verticals when the toeboard is installed) As shown in FIGS. 1A and 4A, one embodiment of the toeboard 1 is generally a "C" shaped member, preferably formed from lightweight metal pieces (such as aluminum, aluminum alloy or 18 gauge steel). As shown FIG. 1A, and the cross section of FIG. 4A, the toeboard 1 has a generally closed front side or sidewall 100 that may include an outwardly extending sloped section 5. As shown, the front section slopes so that the bottom edge 31 of toeboard 1 wider (as measured on a line 90 degrees to the axis of the toeboard) than the top edge 30. The sloped section 5 on the front side 100 of the toeboard 1 is preferred but is not required. The toeboard 1 can be in the range of 3-6 or 7+ inches in height, depending on the application or the scaffold type to which it will be attached.

The back or rear side 200 of the toeboard 1 has two opposed lip sections, 201 and 202, with on opening 203 between the lip sections (forming a split rear sidewall). The toeboard 1 rear sidewall may be generally closed, but this is not preferred as this adds weight to the toeboard 1. The toeboard lip sections 201 and 202 provide strength and rigidity to the toeboard 1. The interior of the toeboard 1 forms a channel 90. One terminating end of the toeboard body 1 is the fixed end 20, while the other terminating end is the adjustable end 40.

Figure 4C:
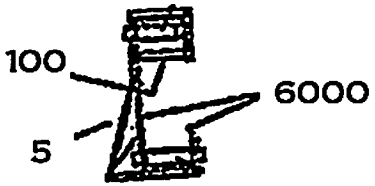
FIG. 4C is a cross sectional view through the fixed termination end of the toeboard system.
Figure 5:
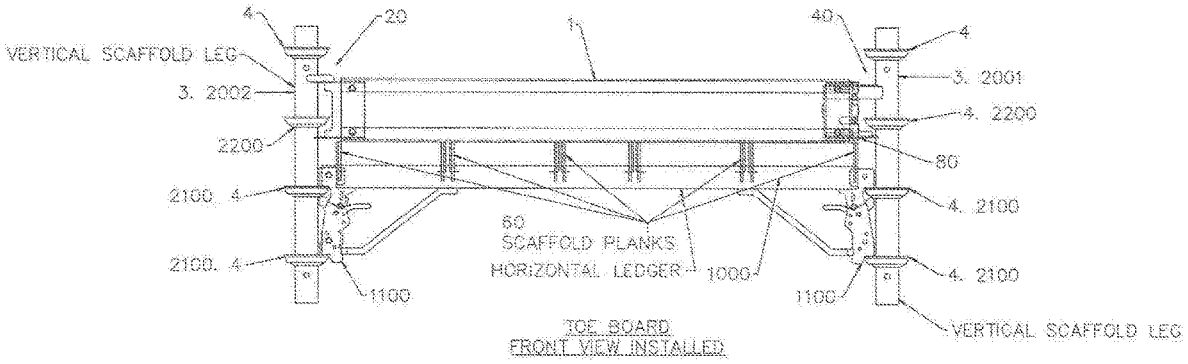
FIG. 5 is a side elevation view of one embodiment of a toeboard installed between tow vertical scaffold members.
Figure 16:
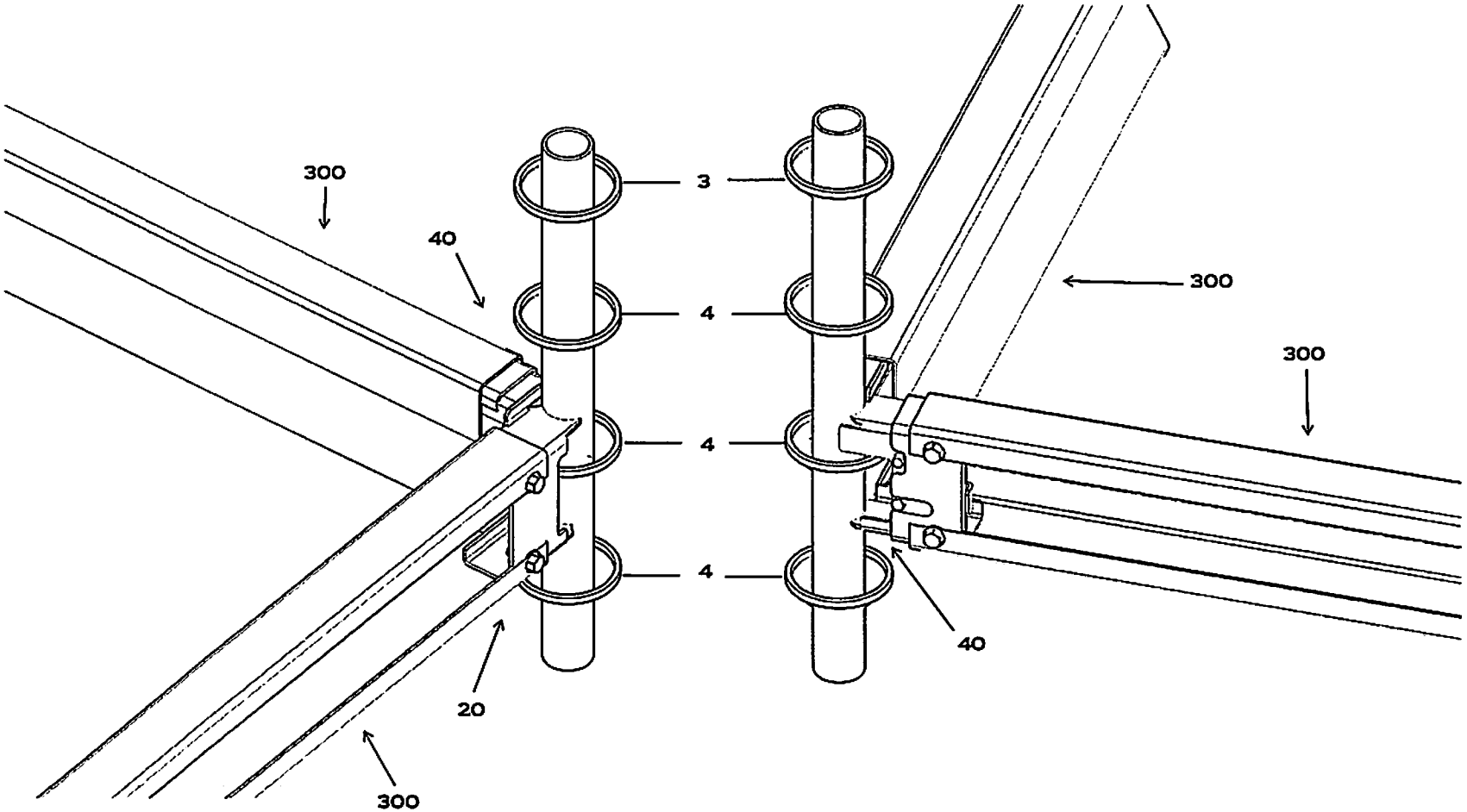
FIG. 16 is a perspective view of the toeboard system of FIG. 1A installed.

In FIGS. 1-6, the toeboard 1 will be described with reference to the Excel Modular Scaffold System, where vertical scaffold members 3 have annular upstanding cups 4 positioned about every six inches on the vertical tubular member 3. For example FIGS. 5 and 16 shows a toeboard 1 installed between two vertical scaffold members 3 on an Excel type system. As shown, each of the vertical scaffold members 3 (or "scaffold verticals") a cylindrical shaped tubular member with cups or rosettes periodically attached to the other diameter of the tubular member, but the invention is not so limited. As shown in FIG. 5, the scaffold horizontal member 1000 (or "scaffold horizontal") is positioned between two scaffold vertical members 2001 and 2002, each having annular cups 4 attached thereto. The scaffold horizontal member 1000 has end connectors 1100 at each end of the horizontal member that couple a particular vertical cup(s) 2100. As shown, each end connectors 1100 couples to two adjacent vertical cups 2100 on a scaffold vertical, which adds stability (but is not required).

Once the scaffold horizontals 1000 and vertical scaffold members 3 are assembled into a scaffold frame, scaffold planks 60 are positioned between spaced apart horizontal members 1000 at a particular height, to create a working surface. While scaffold planking 60 may be wooden board, a more preferred scaffold plank is a metal board (generally a U-shaped board to provide stiffness) where the underside of the board has downwardly facing cutout members attached thereon. The cutout members are metal plates that have a section removed or cut out, where the exposed edge of the remaining material is shaped accommodate the shape of the horizontal scaffold member 1000, on which the cutout member will rest. In many cases, when the scaffold horizontal members are cylindrical or tubular pipe members, the cutouts sections can be semicircles or arcs.

As can be seen in FIG. 5, the resulting top surface 80 of the scaffold floor lies slightly below one of the cups 4 on the scaffold vertical members 3. Also shown in FIG. 16 is one embodiment of the toeboard 1 installed between two vertical scaffold members 3. In use, it is preferred that a portion of the toeboard 1 bottom edge 31 will rest on the top 80 of the scaffold deck. The sloped section 5 of the toeboard 1 (which faces the interior of a scaffold frame) kicks the front bottom edge 31 of the toeboard 1 further toward the interior of the scaffold frame, and provides additional area on the bottom edge 31 surface for support. The toeboard 1 consequently can function to "hold down" or constrain upward motion of the installed scaffold planks 60. As shown in FIG. 1A, the front side 100 of the toeboard may have openings 91 therethrough (aligned with similar openings in the bottom edge 31) to accommodate a nail or a screw to allow the toeboard 1 to be attached to a wooden scaffold plank or planks.

Positioned on the fixed terminating end 20 of the toeboard 1 is a second sleeve 5000. As shown in FIGS. 1A and 4B and 4C, second sleeve 5000 is a "C" shaped preferably aluminum body that is partially positioned in the interior 90 of the fixed terminating end 20, as can be seen in the ghosted views of FIGS. 6A and 6B. As used herein, a "C" shaped body has top portion, a bottom portion, a closed sidewall, and an open sidewall. The open sidewall (the open end of a "C") preferably has a top lip and bottom lip sections, and is empty or open between the top and bottom lip sections, such as shown in FIG. 4B. When sleeve 5000 is positioned in the interior of toeboard 1, preferably, the open sidewall of sleeve 5000 faces the front closed sidewall of the toeboard 1, as shown in FIG. 1A. When installed, the second sleeve 5000 is fixed with respect to the fixed terminating end 20, for instance, with bolts through the rear side of the toeboard body 1 (see FIG. 1A). The portion of the installed second sleeve 5000 protruding from the interior of the toeboard body 1 is the second sleeve's front edge 5100.

Figures 2A, 2B, 3A, 3B:
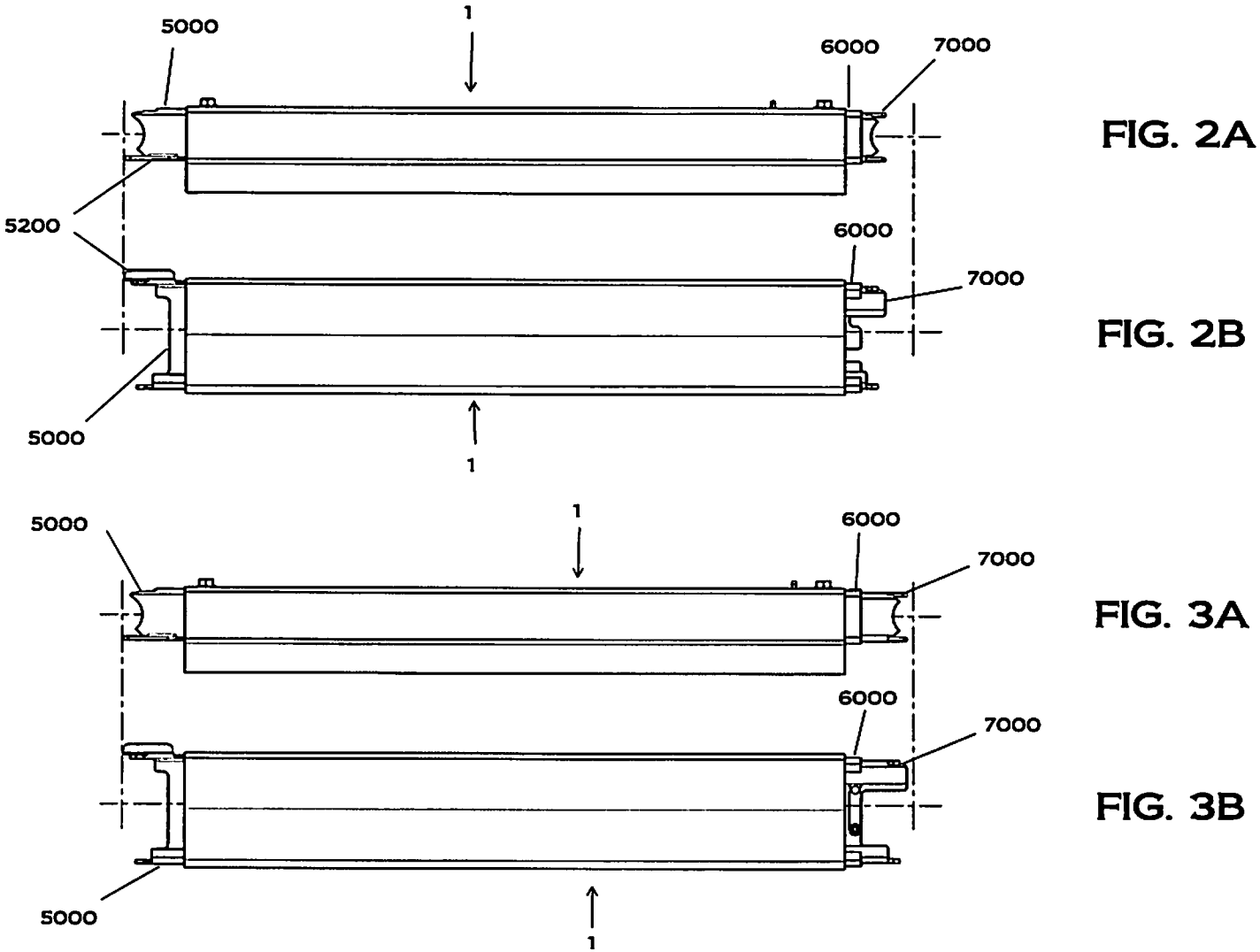
FIG. 2A is a top elevation view of the toeboard system of FIG. 1A in a closed or retracted position.
FIG. 2B is a front elevation view of the toeboard system of FIG. 1A in a closed or retracted position.
FIG. 3A is a top elevation view of the toeboard system of FIG. 1A in a deployed position.
FIG. 3B is a front elevation view of the toeboard system of FIG. 1A in a deployed

Second sleeve 5000 has a top 5001 and a bottom surface 5002, a front side and a generally open rear side. The front edge 5100 of the second sleeve 5000 preferably has at least one projecting finger 5200 extending axially outwardly from the top surface of the sleeve 5000. As shown in FIG. 1A, the projecting finger 5200 is upwardly facing from the top surface, but it may also be a downwardly facing (or simply extending axially from the front edge, as on the adjustable end later described). In other embodiments, both the front and rear surface of the front edge of the sleeve 5000 may have projecting fingers extending axially from the front edge 5100, and be upward facing, downward facing, or one up and one downward facing. If two fingers 5200 are present, the horizontal distance between the two fingers is slightly greater that the diameter of the vertical scaffold member body 3. If a single finger 5200 is used, preferably the single finger 5200 is on the open sidewall of the second sleeve 5000, adjacent the front side of the toeboard body 1, as shown in FIG. 1A. The finger(s) 5200 help to stabilize the fixed end 20 of the toeboard 1 when coupled to a vertical member 3. The projecting finger(s) may be integrally formed with the second sleeve 5000 (as shown in the figures) or be fixedly attached to the second sleeve 5000 (not shown). The top front edge (such as between two fingers 520) and bottom front edge of the sleeve 5000 may be arc shaped to interface with a round tubular vertical scaffold member, such as shown in FIGS. 1A and 2A. The front and rear sidewalls of sleeve 5000 have an area of the wall near the front edge excised, to avoid interference with an annular member that will be present in an Excel System (see FIG. 2A and FIG. 16.

The terminating end of the toeboard 300 opposite the fixed end 20 is the adjustable terminating end 40. Preferably, the adjustable end 40 will have fixedly mounted on the interior of the toeboard body 1 (such as with bolts and nuts) a first sleeve 6000. The first sleeve 6000 is generally a "C" shaped preferably aluminum sleeve, that is fixedly attached the toeboard body 1, such as with bolts As shown in FIG. 1A, preferably the closed sidewall of "C" faces the rear portion of the toeboard body 1, when mounted thereto. Slidably mounted in the interior of the first sleeve 6000 is a slide lock sleeve 7000, preferably also "C" channel shaped body, with the closed sidewall of the slide lock sleeve facing the closed sidewall of the first sleeve 6000. The slide lock sleeve 7000 has two oval shaped openings 7900 on the closed sidewall portion (see FIG. 1C) to accommodate the bolts and nuts that fix the first sleeve 6000 to the toeboard body 1 (thereby allowing the slide lock sleeve 7000 to slide with respect to the first sleeve 6000). These openings 7900 have a front and a rear edge acting as front and rear stops, limiting the movement of the slide lock sleeve 7000. The front edge of the opening 7900 prevents the slide lock sleeve 7000 from sliding completely off the toeboard 1, while the rear edge prevents the slide lock sleeve for sliding completely into the interior of the toeboard 1.

Figure 1C:
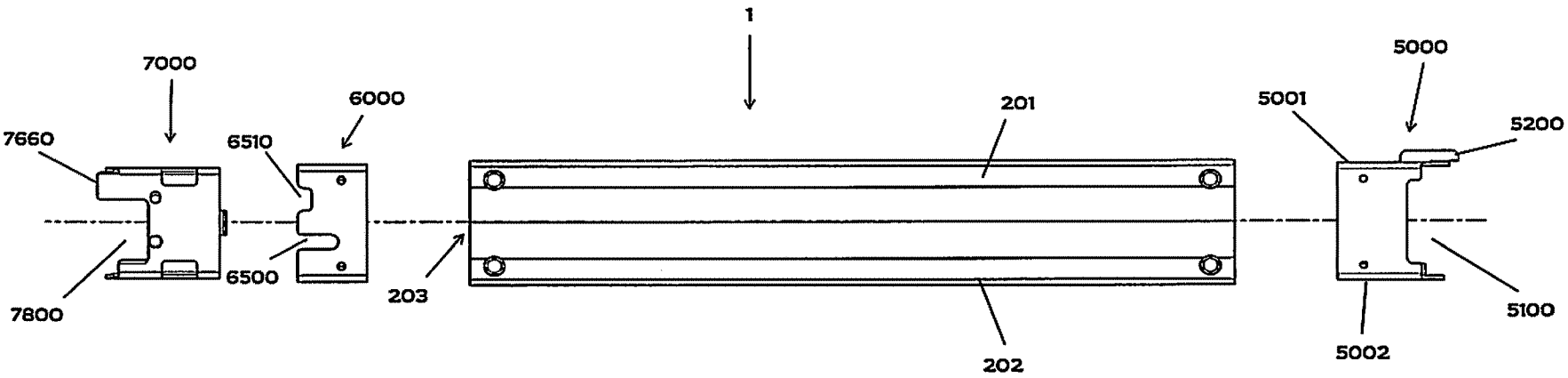
FIG. 1C is a rear exploded elevation view of the toeboard system of FIG. 1A.
Figure 6A:
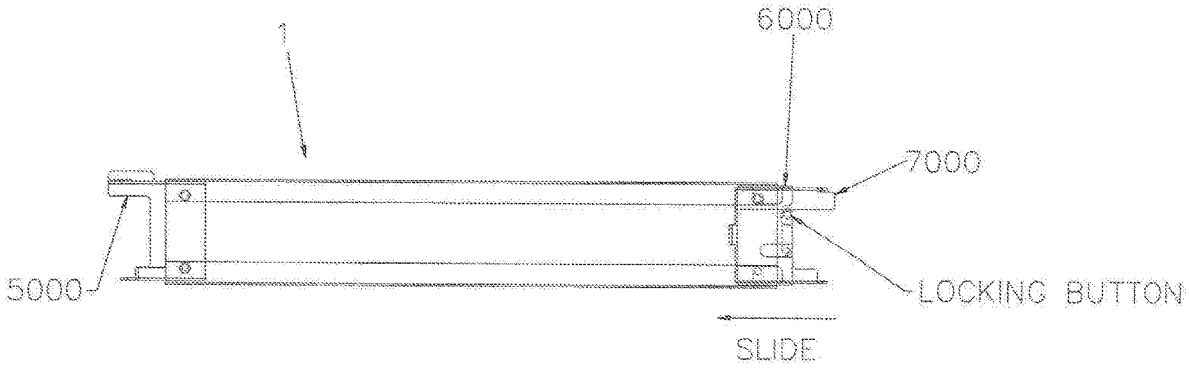
FIG. 6A is a front ghosted elevation view of the toeboard system of FIG. 1A.
Figure 6B:
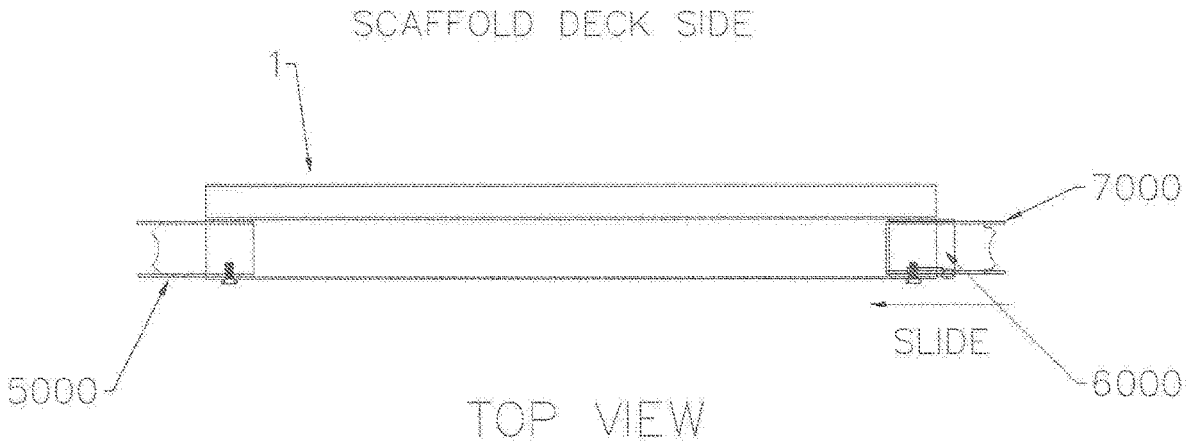
FIG. 6B is a top ghosted elevation view of the toeboard system of FIG. 1A.
Figure 6C:
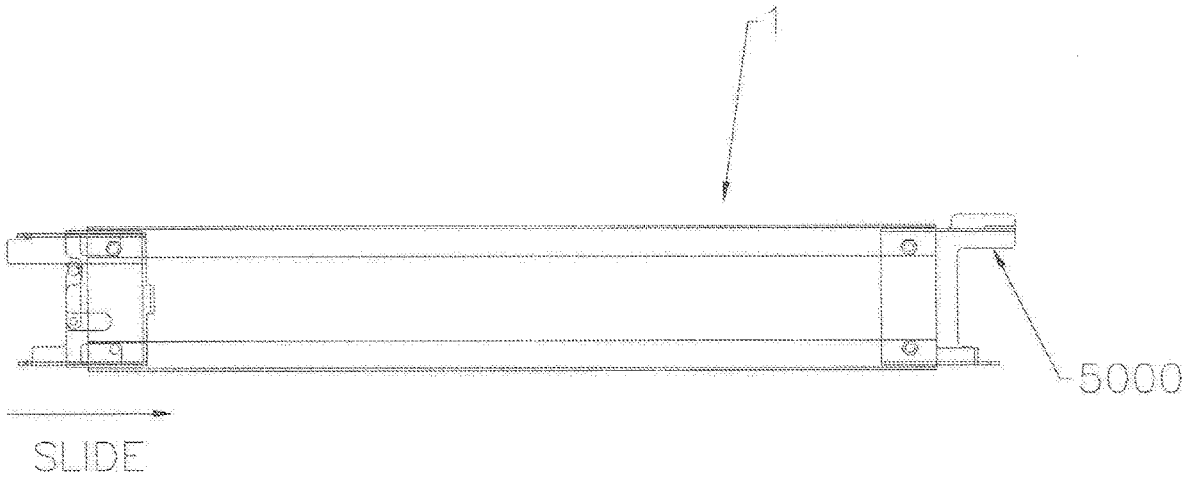
FIG. 6C is a rear ghosted elevation view of the toeboard system of FIG. 1A.

To fix the position of the slide lock sleeve 7000, with respect to the toeboard 1 of first sleeve 6000, the toeboard system preferably will have a lock member. In one embodiment, the lock member is mounted on the slide lock sleeve 7000 and removably couples to the first sleeve 6000. Preferably, lock member maybe a spring loaded clip, snap button or lock or pushpin lock. As shown in FIG. 1C, one lock member is a button 8000 mounted on as strip 8010 attached to the slide lock sleeve 7000. The strip 8010 is attached (bolted) to sleeve 7000, but the strip 8010 is sufficiently thin to be flexible to allow a user to depress the button 8000, flexing the member 8010 to allow button 8000 to clear the sidewall of first sleeve 6000. As shown in FIG. 1A or 6A, the first sleeve 6000 has a first slot 6500 to accommodate the lock member's mounting bolt 8090, and a second slot 6510, to accommodate the button 8000. When deployed, the button 8000 prevents the slide lock sleeve 7000 from retracting back into the interior of the first sleeve 6000, as the button 8000 will catch on the terminating end of slot 6510. Instead of an slot 6510, the lock's button or clip may engage with an opening located in the first sleeve 6000 (not depicted), thereby locking the position of the slide lock sleeve 7000 with respect to the first sleeve.

Figure 1D:
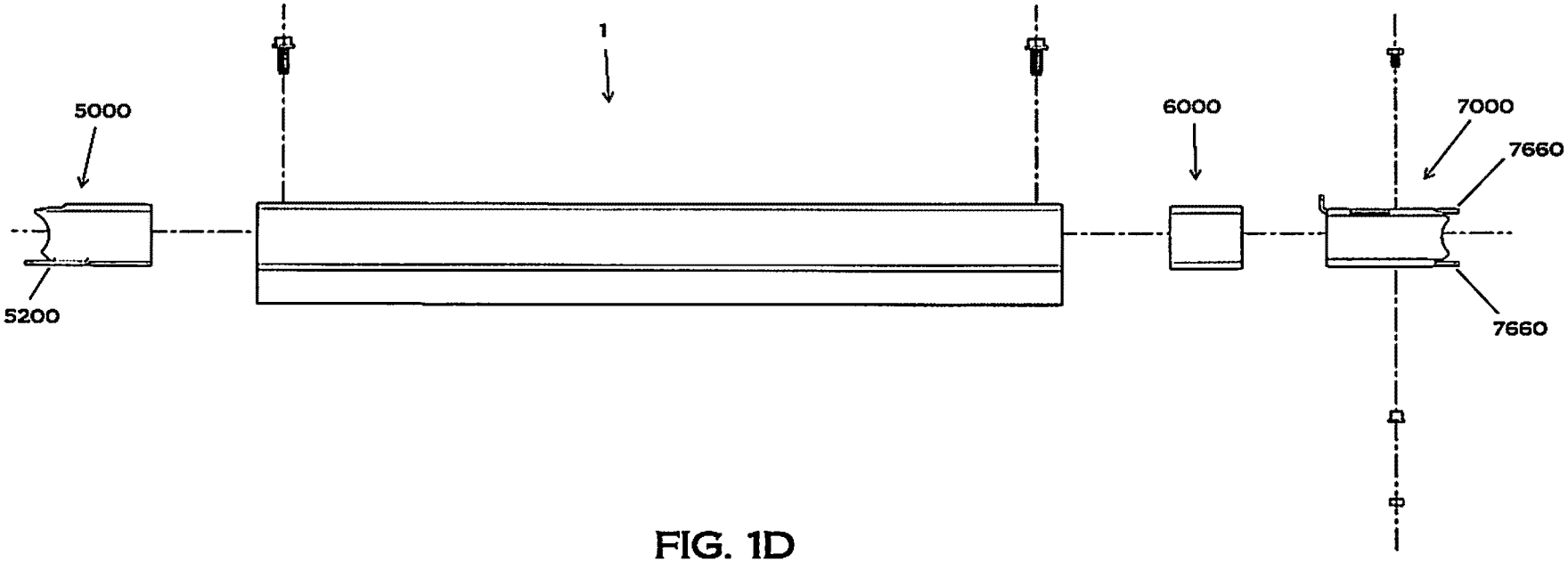
FIG. 1D is a top exploded elevation view of the toeboard system of FIG. 1A.

The slide lock sleeve 7000 has a top edge 7200, a bottom edge 7220, a front sidewall 7230, a rear sidewall 7240 and a front edge 7210. Note that the front and rear sidewalls of the sleeve 7000 also have an area of the wall 7800 near the front edge excised, to avoid interference with an annular member that will be present in an Excel System (see FIG. 16). The slide lock sleeve 7000 preferably has a hollow interior 7060. As shown in the FIG. 1A, one embodiment of the slide lock sleeve 7000 includes two finger(s) or tab(s) 7660 projecting axially from the terminating end of the slide lock sleeve 7000. A single tab could be employed, but this is not preferred. Between the tabs or fingers 7660, the slide lock sleeve 7000 may be shaped to engage the vertical scaffold members 3, such as being semicircular or arc shaped, such as shown in FIGS. 1A and 1D. The projecting fingers or tabs 7660 preferably extend outwardly from the front top edge of the slide lock sleeve 7000 (but could project outwardly from the bottom edge of the slide lock sleeve). When the slide lock sleeve 7000 is deployed, or slid forward, out from the interior of the first sleeve 6000, into a locked configuration (see FIGS. 3A and 3B), the fingers or tabs 7660 will be adjacent to the coupled vertical scaffold member 3, trapping the vertical scaffold member 3 between the fingers or tabs 7660, thereby locking the toeboard system in place horizontally. The tabs 7660 preferably extend about ⅛, ¼, or ½ of the diameter of a vertical scaffold member. The tabs 7660 could extend almost the entire height of the slide lock sleeve 7000 if interference with an annular cup on a vertical 3 is not an issue.

To release or disengage the sleeve 7000, lock member 8000 is released, and slide lock sleeve 7000 is slid rearwardly (towards or into the toeboard 1) into the interior of the first sleeve 6000, allowing the fingers or tabs 7660 to clear the adjacent vertical scaffold member (see FIGS. 2A and 2B). In the released position, the toeboard 1 is easily moved horizontally, (such as by sliding along the floor) and removed from the scaffold structure's edge. There is no need to move the toeboard 1 vertically to engage or disengage the toeboard system 300 between vertical 3.

The arc shape of the bottom front edge of the slide lock sleeve 7000 can be eliminated, but removal allows some sidewise rotation of the toeboard system about the vertical member 3, which is not preferred. As shown, the two tabs 7660 are near the top edge of the slide lock sleeve 7000, but could be located near the bottom edge or near the middle of the sidewall. The two tabs do not have to be vertically aligned, but there position should be accounted for in the design of the fixed end. In the embodiment shown in FIGS. 2 and 4, interference is an issue, so slide lock sleeve lock behind the tabs is shaped to accommodate an interfering cup or annular member (see FIG. 2, showing interfering cups 2200).

Shown in FIGS. 2A and 2B is the position of the slide lock sleeve 7000 in a released, retracted or unlocked position, and in FIGS. 3A and 3B, in a deployed or locked configuration. When the slide lock sleeve 7000 is slid outwardly from the interior of the first sleeve 6000 (and the interior of the toeboard body 1) into a locked configuration, forward motion of the slide lock sleeve 7000 will be stopped by bolts engaging the rear edge of openings 7900. While sliding forward, lock member (here button 8000) will spring forward into slot 6510 on first sleeve 6000, preventing the slide lock sleeve 7000 from sliding or retracting back into the interior of the first sleeve 6000. In lieu of slot 6510, an opening or hole could be used to engage the button 8000 and lock the slide lock sleeve 7000 to the first sleeve 6000.

In operation, a toeboard system 300 is installed as follows: once the scaffold floor is installed, the adjustable end 40 is positioned in a retracted or unlocked configuration, and the fixed terminating end 20 is slid into position adjacent a vertical scaffold member 3. The fixed end second sleeve 5000 engages the vertical 3, and the projecting finger 5200 engages the adjacent vertical 3. When the fixed end engages a vertical 3, preferably both the top edge and bottom edge of the first sleeve 5000 will touch or contact the vertical 3. The adjustable end 40 of the toeboard 1 is slid or pivoted adjacent the opposing vertical scaffold member 3. The slide lock sleeve 7000 is slid forward and deployed, bringing the tabs or fingers 7660 forward to capture the vertical scaffold member 3 between the tabs or fingers 7660. The lock member deploys (the button 8000 snaps into the slot 6510), preventing retraction of slide lock sleeve 7000, locking the slide lock sleeve in the deployed position, Preferably, when engaged, both the top edge 7200 and bottom edge 7220 of the lock member body will contact or touch the vertical member 3.

Generally, a toeboard 1 will be placed between each pair of vertical scaffold members 3 on the outer perimeter of the scaffold deck (excluding access points to the scaffold deck). Preferably, the toeboards 1 are orientated so that the adjustable end 40 of a first toeboard 1 is positioned adjacent the fixed end 20 of the adjacent toeboard (see FIG. 16). When installed, the design of the fixed ends projecting fingers (if present) should be accounted for in the design of the projecting fingers or tabs on the adjustable terminating end, to avoid interference between adjacent toeboards.

As described, the toeboard system 300 directly couples to adjacent vertical scaffold members 3. Note, for the scaffold system depicted in FIGS. 1-3 (the Excel system), the bottom edge of an installed toeboard system 300 is located immediately below a vertical scaffold annular member 4 (see FIG. 16). Consequently, when the toeboard 1 is locked in position, it cannot be lifted off the verticals 3; that is, the toeboard is locked in place both horizontally and vertically. In other scaffold systems, the top of the toeboard 1 may be adjacent a vertical scaffold annular member, providing the preferred vertical "lock" of the toeboard. However, for some scaffold systems, annular members 4 (such as a cup or rosette) may not be positioned on the vertical scaffold member 3 to provide the vertical restraint to an installed toeboard. In such systems, a toeboard holddown can be used to provide the vertical restraint.

One embodiment of a toeboard holddown 500 is shown in FIG. 9. As shown, the holddown 500 includes an attachment member 510, to attach the holddown 500 to a vertical scaffold member 3. The attachment member can include a clamp, such as a pivoting or hinged tube clamp shown in FIGS. 9C and 9D, adapted to clamp onto the vertical tubular member 3. Alternatively, the clamp may be adapted to clamp onto an annular member 4 positioned on a vertical scaffold member, such as using the wedge as a clamp, as shown on FIG. 10. In this embodiment, the locking member 510 includes two offset aligned openings 560 on the holddown, offset about the thickness of the rosette. In positioning the wedge 570 through the openings 560 and the rosette opening on the vertical member, the wedge 570 acts to clamp the holddown to the rosette on the vertical member.

Figure 12A:
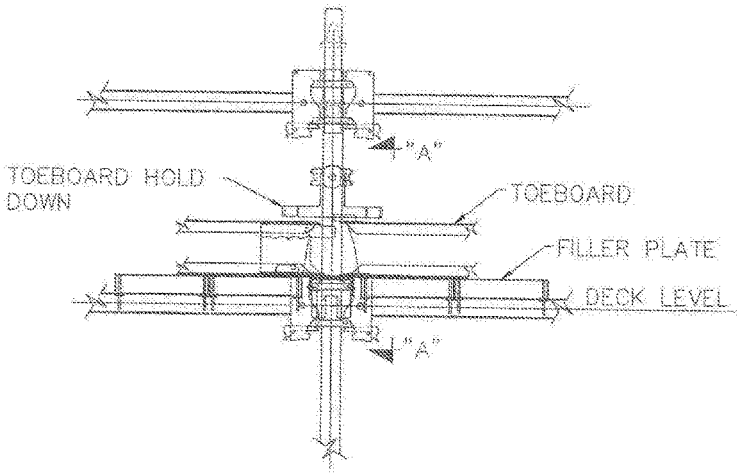
FIG. 12A is a front view of one embodiment of a holddown installed on a Safeway scaffold system frame.
Figure 12B:
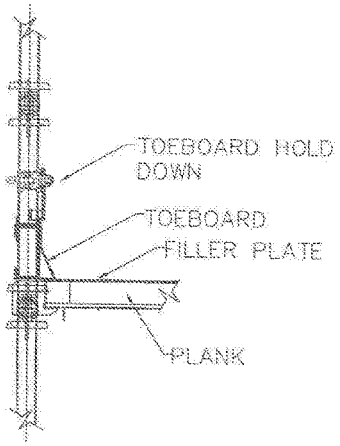
FIG. 12B is a cross sectional view through FIG. 12A.
Figure 13A:
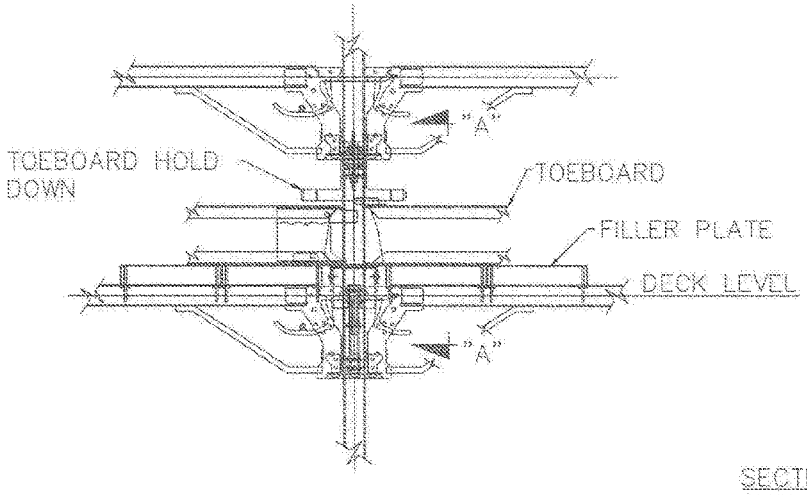
FIG. 13A is a front view of one embodiment of a holddown installed on a Next Gen scaffold system frame.
Figure 13B:
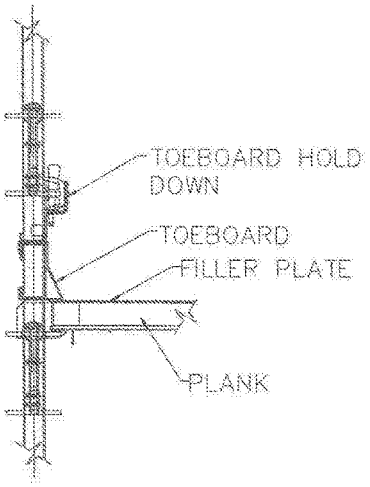
FIG. 13B is a cross sectional view through FIG. 13A.
Figure 14A:
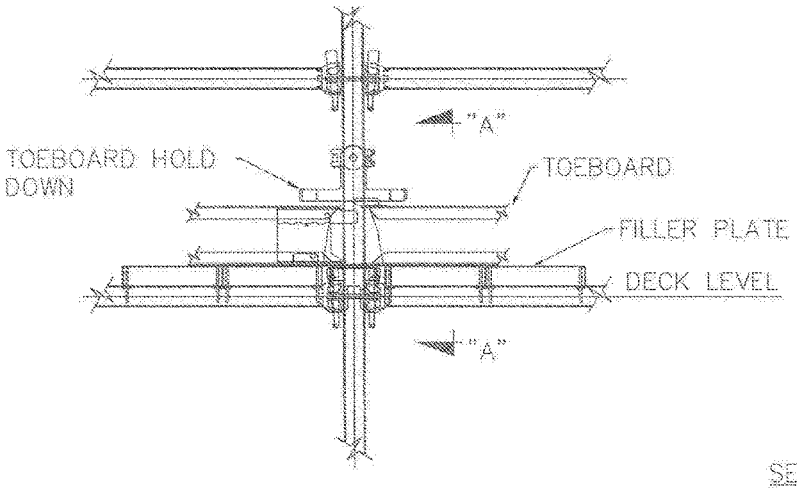
FIG. 14A is a front view of one embodiment of a holddown installed on a wedge lock scaffold system frame.
Figure 14B:
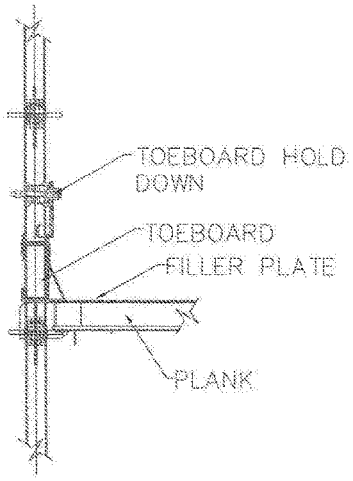
FIG. 14B is a cross sectional view through FIG. 14A.

The holddown 500 shown in FIGS. 9 and 10 include a "T" shaped member 590, having two projecting arms 591 and 592 forming the "top" of the "T." The projecting arms may be flat extensions, may be bent (such as shown in FIG. 9D or 10D) or curved (not shown). The holddown 500 will be mounted on a vertical scaffold member 3 above a toeboard. The clamp will be positioned so the projecting arms 591 and 592 of the holddown 500 are located adjacent to the top edge 30 of a toeboard, such as depicted in FIGS. 12-14. The arms 591 and 592 extend over the toeboard, and hence, the arms resist upward movement of an installed toeboard 1. As shown in FIGS. 12-14, a single "T" shaped holddown can be mounted to a vertical to restrain two inline toeboards 1, or to two toeboards coupled to a vertical member at an angle (such as a 90 degree angle present at an outer corner of a scaffold deck).

Alternatively, the holddown 500 can be a straight plate like member with the clamp positioned in the center (not shown), or a holddown 500 having a single projecting arm 600, forming an "L" shaped member, such as shown in FIG. 11. The single projecting arm is shown as flat or planar in FIG. 11, but the arm could be bent or curved. For instance, at a corner of the platform deck, the "L" shaped single projecting arm holddown can be used to holddown a single toeboard. To vertically restrain two inline toeboards joined at a vertical scaffold member between the two toeboards, two single arm holddowns could be used (one per toeboard), one mounted near the front portion of one toeboard, the other mounted near the rear portion of the other toeboard. Single arm holddowns can also be manufactured as a "right" and "left" orientated or "handed" single arms. Alternatively, the holddown may simply be a clamp body, such as clamp 510 (FIG. 9D) with no projecting arms attached. The clamp alone may provide sufficient lateral extension to trap the toeboards in place vertically.

On a particular rectangular scaffold working deck, the edges of the scaffold planks may not extend sufficiently far to the outer perimeter to provide horizontal floor support for a toeboard. This may be due to the design of the scaffold planks or may result from how the scaffold planks are mounted onto the supporting horizontal members. In this instance, a filler plate 700A can be used to support the toeboard 1, where the filler plate 700A will be supported by the horizontal member 1000 that connects the two verticals 3, to which the toeboard 1 will be coupled. One embodiment of filler plate is shown in FIGS. 15A, 15B, 15C and 15D. As shown, the filler plate includes a flat deck member 700, such as a metal plate. Generally, the deck member 700 is dimensioned similarly to metal scaffold deck planking, and can come in various lengths, such as 6-12 feet. Centered on the underside of the deck member 700 is a U-shaped box channel 710. Periodically positioned in and across this channel are cutout plate members 702, where the plate members have generally semicircular or arc-shaped cutout sections (when the horizontal scaffold members are round pipes) to embrace and rest on a horizontal scaffold member 1000. The cutouts are sized in depth so that when the cutout is resting on a horizontal scaffold member 100, the bottom underside of the deck member 700 is resting on the top surface of a scaffold deck. At each terminating end of the channel 701, the filler plate may include a cutout member 703 where the cutout is shaped to accommodate the end connector positioned on the horizontal member. For instance, for Excel-type end connectors, the cutout 703, shown in FIG. 15C, is more rectangularly-shaped than arc-shaped. The rectangular shape captures the horizontal member's end connector and helps resist rotation of the filler plate 700A when mounted to a horizontal scaffold member 1000.

Figure 7B:
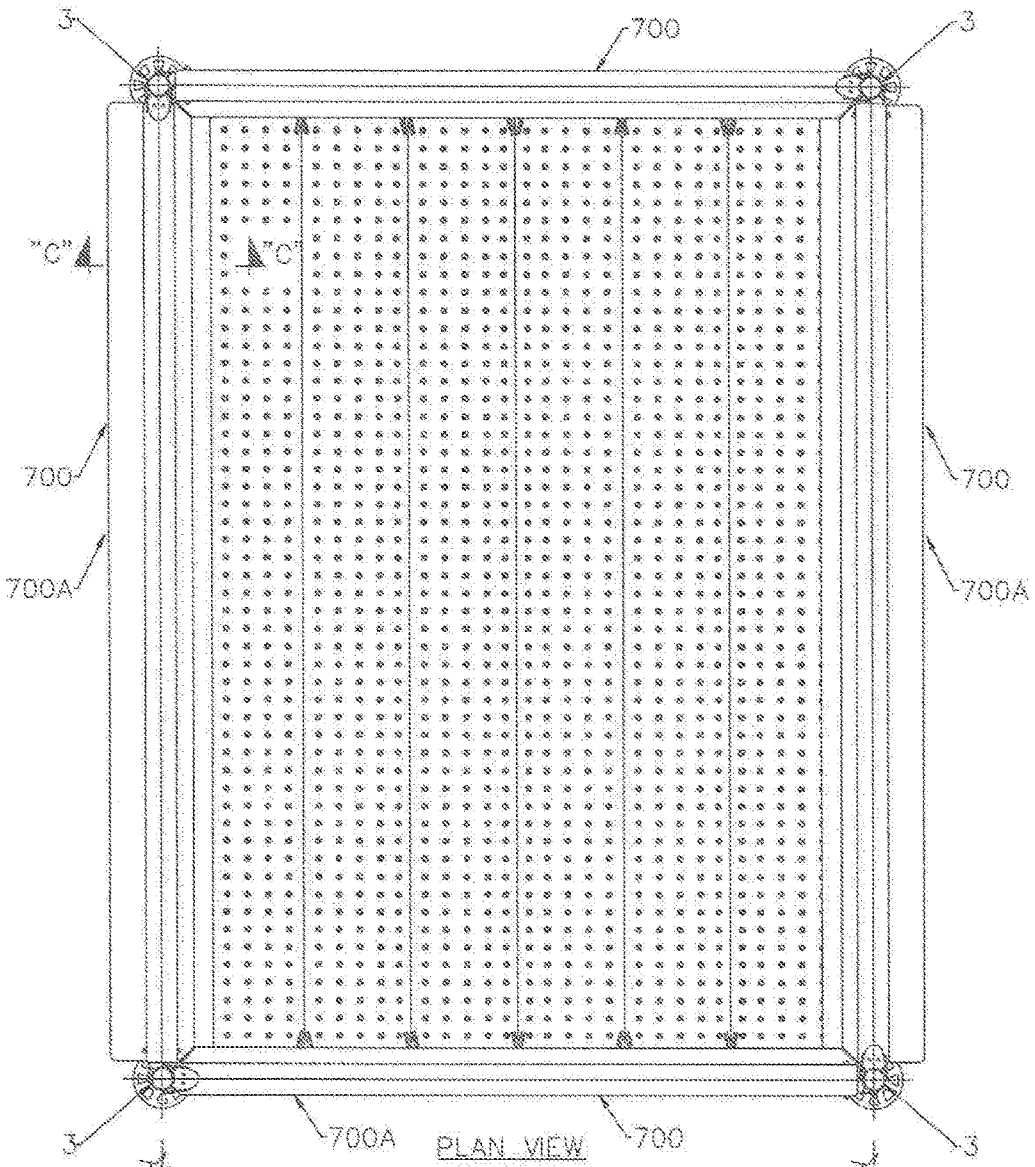
FIG. 7B is a top view of one embodiment of a scaffold deck on a Next Gen system scaffold frame.
Figure 7A:
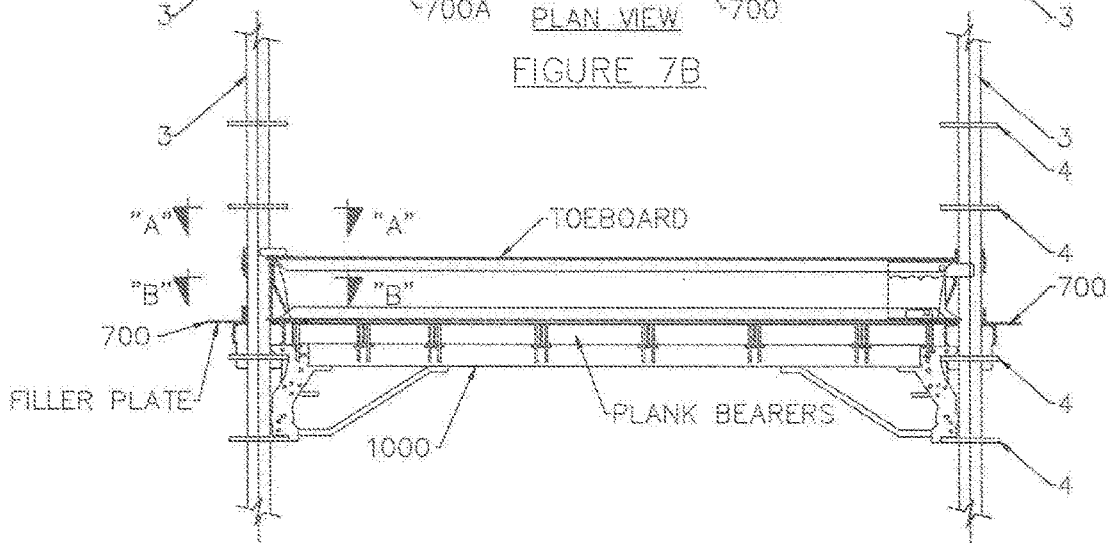
FIG. 7A is a side view of one embodiment of the scaffold toeboard system installed in a Next Gen system scaffold.
Figure 8C:
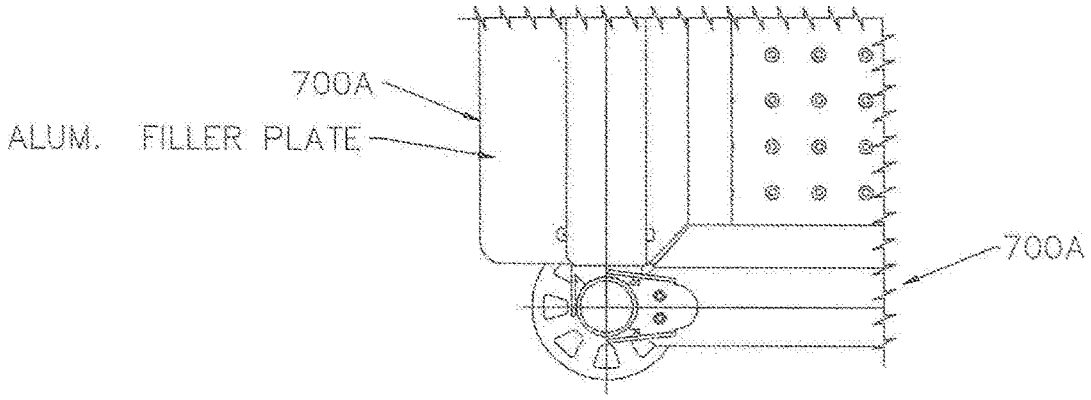
FIGS. 8A, 8B and 8C are sections taken through the scaffold frame of FIGS. 7A and 7B.
Figure 8B:
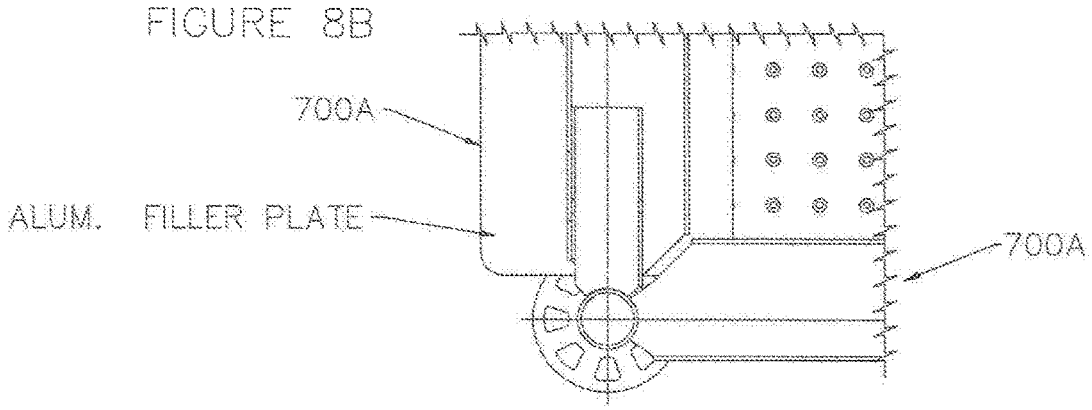
Figure 8A:
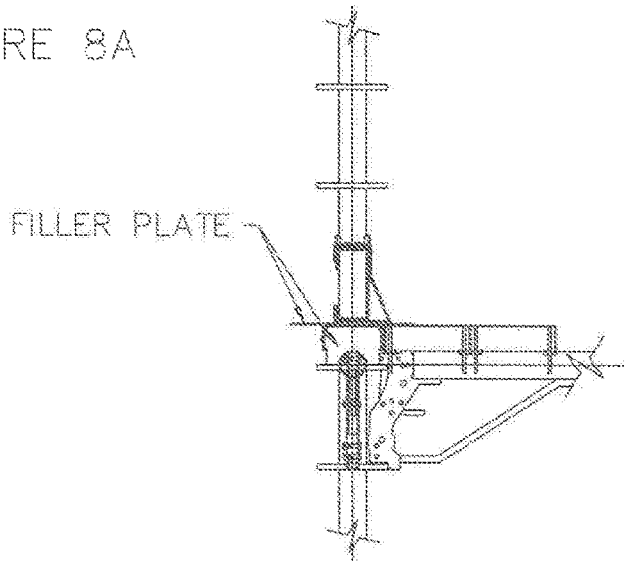

FIGS. 8, 7A and 7B show filler plates 700A mounted onto a scaffold deck where the horizontal end connectors are the Next Gen-type end connectors.

To use a filler plate 700A for supporting a toeboard 1, the filler plate 700A is positioned on the edge of the platform deck, aligning the center channel 710 with the outer horizontal scaffold member 1000. The filler plate 700A is lowered until the cutouts 702 and 703 are supported by the horizontal scaffold member and/or end connectors, and the underside of the deck member 700 is resting on the deck or scaffold floor. The toeboards 1 can then be positioned between the vertical scaffold members, supported from below by the installed filler plates 700A. As shown in FIG. 16, the filler plate 700A may also be used to bridge gaps in the interior of the scaffold deck.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A scaffold toeboard system for locking a toeboard between a first vertical scaffold member and a second vertical scaffold member where each of the first vertical scaffold member and the second vertical scaffold member comprises a tubular member having a diameter and an outer shape;

said toeboard system comprising the toeboard, which comprises an elongated member defining a longitudinal axis, the toeboard having a fixed terminating end and an adjustable terminating end; the toeboard further comprising a top portion, a bottom portion and a front sidewall connecting the top portion and the bottom portion, defining a hollow interior channel;

a second sleeve attached to the fixed terminating end of the toeboard; the second sleeve having a second sleeve top portion, a second sleeve bottom portion, and a second sleeve front sidewall connecting the second sleeve top portion and the second sleeve bottom portion;

the second sleeve having a second sleeve terminating end, including a second sleeve front edge located distal to the toeboard fixed terminating end; the second sleeve further comprising at least one finger extending outwardly from the second sleeve front edge, the at least one finger substantially aligned with the longitudinal axis of the toeboard;

a first sleeve fixedly attached to the adjustable terminating end of the toeboard, the first sleeve having a first sleeve top portion, a first sleeve bottom portion, and a first sleeve front sidewall connecting the first sleeve top portion and the first sleeve bottom portion;

the first sleeve having a first sleeve terminating end positioned distal to the toeboard adjustable terminating end;

a slide lock sleeve slidably mounted to the first sleeve, the slide lock sleeve slidable with respect to the first sleeve from a retracted position to an extended deployed position; the slide lock sleeve comprising a slide lock top portion, a slide lock bottom portion, and a slide lock front sidewall connecting the slide lock top portion and the slide lock bottom portion, and two partial rear sidewalls, and at least one tab extending outwardly from a slide lock sleeve terminating end of the slide lock front sidewall or of an upper one of the two partial rear sidewalls, where the slide lock sleeve terminating end is positioned distal to the toeboard's adjustable terminating end, the at least one tab being substantially aligned with the longitudinal axis of the toeboard;

the first sleeve and the slide lock sleeve being partially disposed in the hollow interior channel of the toeboard; and a locking mechanism, the locking mechanism positioned at the toeboard system's adjustable terminating end; the locking mechanism, when locked, fixes the slide lock sleeve in the extended deployed position.

2. The toeboard system of claim 1 wherein the at least one tab comprises a first tab and a second tab; the first tab positioned on the front sidewall of the slide lock sleeve, the second tab positioned on one of the two the partial rear sidewalls of the slide lock sleeve, the first tab and the second tab separated by a horizontal distance of about the tubular member's diameter of the first vertical scaffold member or the second vertical scaffold member.

3. A combination of a scaffold toeboard system and a first vertical scaffold member and a second vertical scaffold member, each said first vertical scaffold member and said second vertical scaffold member comprising a tubular member having a series of outwardly extending annular members fixedly mounted on the tubular member, each said tubular member having a diameter;

the scaffold toeboard system comprising a toeboard which comprises an elongated member defining a longitudinal axis, the toeboard having a fixed terminating end and an adjustable terminating end; the toeboard further comprising a top portion, a bottom portion, and a front sidewall connecting the top portion and the bottom portion, and a rear portion opposed to the front sidewall, defining a hollow interior channel;

a second sleeve fixedly attached to the fixed terminating end of the toeboard, the second sleeve having a second sleeve top portion, a second sleeve bottom portion, and a second sleeve front sidewall connecting the second sleeve top portion and the second sleeve bottom portion; the second sleeve having a second sleeve terminating end edge distal to the toeboard's adjustable terminating end, the second sleeve further comprising at least one finger extending outwardly from the second sleeve terminating end edge, the at least one finger being substantially aligned with the longitudinal axis of the toeboard;

a first sleeve positioned at the adjustable terminating end of the toeboard, the first sleeve having a first sleeve top portion, a first sleeve bottom portion, and a first sleeve front sidewall connecting the first sleeve top portion and the first sleeve bottom portion; the first sleeve having a first sleeve terminating end edge distal to the toeboard's adjustable terminating end;

a slide lock sleeve positioned at the adjustable terminating end of the toeboard and slidably mounted to the first sleeve, and slidable from a deployed position to a retracted position; the slide lock sleeve further comprising a slide lock sleeve top portion, a slide lock sleeve bottom portion, and a slide lock sleeve front sidewall connecting the slide lock sleeve top portion and the slide lock sleeve bottom portion, and two partial slide lock sleeve rear sidewalls, at least one tab extending outwardly from a slide lock sleeve terminating end edge of the slide lock sleeve front sidewall or of an upper one of the two partial slide lock sleeve rear sidewalls, the slide lock sleeve front terminating end edge positioned distal from the adjustable terminating end of the toeboard, the at least one tab being substantially aligned with the longitudinal axis of the toeboard;

a locking mechanism, positioned at the toeboard system's adjustable terminating end; the locking mechanism, when locked, fixes the slide lock sleeve in the deployed position.

4. The combination of claim 3 wherein the second sleeve's terminating end edge includes a second sleeve top edge and a second sleeve bottom edge that are arcuate to engage a first vertical scaffold member's outer shape or a second vertical scaffold member's outer shape.

5. The combination of claim 3 wherein said front sidewall of the toeboard comprises a sloped portion, whereby the toeboard top portion is smaller in dimension than the toeboard bottom portion.

6. The combination of claim 3 wherein said toeboard's hollow interior channel comprises a C-shaped channel and said first sleeve and said second sleeve are fixedly mounted in an interior of the C-shaped channel.

7. The combination of claim 3 wherein said at least one finger is integrally formed with the second sleeve.

8. The combination of claim 3 wherein said at least one finger is fixedly attached to the second sleeve.

9. The combination of claim 8 wherein the second sleeve front sidewall faces the toeboard rear portion, and wherein the first sleeve front portion faces the toeboard rear portion.

10. The combination of claim 3 further comprising a toeboard holddown, the toeboard holddown comprising a clamp member.

11. The combination of claim 10 where said clamp member is a pivoting tube clamp.

12. The combination of claim 10 wherein said clamp member includes a wedge, and wherein said annular members on said first and second vertical scaffold members comprise rosettes having openings therethrough.

13. The combination of claim 3 wherein said lock mechanism comprises a snap button mounted on either the slide lock sleeve or the first sleeve, and engages an opening or a slot in the other of the slide lock sleeve or the first sleeve.

14. A telescoping scaffold toeboard, comprising:

an elongated toeboard body, the elongated toeboard body comprising: i) a top wall, ii) a bottom wall opposed to the top wall, iii) a front sidewall connecting the top wall and the bottom wall, iv) a first terminating end; and v) a second terminating end;

wherein the top wall, the bottom wall, and the front sidewall define an interior channel; and wherein a length extending from the first terminating end to the second terminating end defines a longitudinal axis of the elongated toeboard body;

a telescoping sleeve assembly coupled to the first terminating end of the elongated toeboard body, the telescoping sleeve assembly comprising:

a first sleeve fixedly attached to the first terminating end of the elongated toeboard body with a first mounting fastener and a second mounting fastener; the first sleeve having a first sleeve top wall, a first sleeve bottom wall opposed to the first sleeve top wall, and a first sleeve sidewall connecting the first sleeve top wall and the first sleeve bottom wall, the first sleeve sidewall comprising an upper mounting aperture and a lower mounting aperture formed therein;

a slide lock sleeve slideably coupled to the first sleeve; the slide lock sleeve having a slide lock sleeve top wall, a slide lock sleeve bottom wall opposed to the slide lock sleeve top wall, a slide lock sleeve front sidewall connecting the slide lock sleeve top wall and the slide lock sleeve bottom wall, and a slide lock sleeve rear portion opposed to the slide lock sleeve front sidewall; the slide lock sleeve front sidewall comprising an upper slit and a lower slit; the slide lock sleeve having a first tab projecting longitudinally from the slide lock sleeve front sidewall, and a second tab projecting longitudinally from the slide lock sleeve rear portion to enable coupling to a first vertical scaffold member in a scaffold assembly;

a lock member comprising an elongated spring defining a first end and a second end, wherein the first end is fixedly attached to the slide lock sleeve with a mounting fastener, and wherein the second end comprises a button accessible through an opening formed in the slide lock sleeve sidewall;

wherein the first mounting fastener extends through the upper mounting aperture of the first sleeve and the upper slit of the slide lock sleeve to connect to the elongated toeboard body; and wherein the second mounting fastener extends through the lower mounting aperture of the first sleeve and the lower slit of the slide lock sleeve to connect to the elongated toeboard body; and the telescoping scaffold toeboard further comprising a second fixed sleeve coupled to the second terminating end of the elongated toeboard body; the second fixed sleeve comprising a second fixed sleeve top wall, a second fixed sleeve bottom wall opposed to the second fixed sleeve top wall, and a second fixed sleeve sidewall connecting the second fixed sleeve top wall and the second fixed sleeve bottom wall; wherein at least one finger projects longitudinally from the second fixed sleeve top wall to enable coupling to a second vertical scaffold member in the scaffold assembly.

* * * * *